United States Patent [19]

Baker

[11] 4,222,129

[45] Sep. 16, 1980

[54] ODOR EXTRACTING APPARATUS AND COMBINATION THEREOF WITH A TOILET

[76] Inventor: Ivan M. Baker, Martinez Castro 271, 407 Buenos Aires, Argentina

[21] Appl. No.: 15,549

[22] Filed: Feb. 26, 1979

[51] Int. Cl.[3] ..... A47K 3/22; E03D 9/04; E03D 13/00

[52] U.S. Cl. ..... 4/213; 4/214; 4/215; 4/216

[58] Field of Search ..... 4/213, 214, 216, 215, 4/217

[56] References Cited

U.S. PATENT DOCUMENTS

| | | | |
|---|---|---|---|
| 1,972,774 | 9/1934 | Hartwell | 4/213 |
| 2,023,127 | 12/1935 | Fairchild | 4/213 |
| 2,603,797 | 7/1952 | Baither | 4/214 |
| 4,103,370 | 8/1978 | Arnold | 4/213 |

*Primary Examiner*—Henry K. Artis
*Attorney, Agent, or Firm*—Karl W. Flocks

[57] ABSTRACT

An odor-extracting apparatus for a toilet comprising an extractor element, an electric motor having a drive shaft with one end secured to the extractor element for transmitting drive thereto whereby the odor of a toilet may be extracted directly from the toilet bowl, and a hydraulic pump secured to a second end of the drive shaft to simultaneously obtain drive from the electric motor when the electric motor transmits drive to the extractor element. The odor-extracting apparatus in combination with a toilet including a suction chamber in communication with the bowl cavity, an odor removing duct including a portion in which a water trap may be formed to prevent sewer gas from backing into the toilet followed by downwardly directed discharge section, and an auxiliary tank to which water from the trap portion may be pumped to facilitate odor removal in operation of the odor-extracting apparatus and from which water may flow to the trap portion to form the water trap therein when the odor-extracting apparatus is not in operation.

7 Claims, 7 Drawing Figures

ELECTRONIC RELAY
A
B
C
D
E
24 V.A.C.
110 V.A.C.
M
1
2
3
4
5
6
7
8
9
10
11
12
13
13'
14
17
19
20
23
24
25
26
27
28
52
53
54
60
62
64
66
68
70
72

A
B
C
D
E
68
28
10
11
25
24
1
2
3
4
5
6
7
8
9
12
13
13'
14
15
16
17
18
19
20
23
26
27
51
52
53
54
55

ODOR EXTRACTING APPARATUS AND COMBINATION THEREOF WITH A TOILET

BACKGROUND OF THE INVENTION

1. Field of the Invention

The present invention relates to an odor-extracting or removing apparatus for toilets and the combination thereof with a toilet. Odor removing apparatuses door switches or wall-mounted switch actuating means are known to exist in numerous public facilities. More particularly the present invention relates to an apparatus assembled in combination with the toilet per se and is actuated when the toilet itself, is in use rather than on the mere occupancy of the room or on mechanical actuation of a wall-mounted switch.

2. Description of the Prior Art

Even the case of odor removing apparatuses assembled in combination with a toilet, per se, is known in the prior art. Representative of the prior art apparatuses of the general type over which the invention disclosed herein purports to be an improvement are those disclosed in U.S. Pat. Nos. 3,857,119 (Hunnicutt, Jr.) and 3,913,150 (Poister et al). The Hunnicutt, Jr. system includes a suction fan and duct work on tubing mounted behind a wall as well as an air recirculating unit supported on the floor and presents such possible inconveniences as service difficulty due to inaccessibility of the portions behind the wall and the extra space taken up by the unit on the floor. The Poister et al system while more compact and also more readily accessible than that of Hunnicutt, Jr. may be subject to backing-up effects of sewer gas andor flooded conditions.

SUMMARY OF THE INVENTION

A basic feature of the odor extracting device disclosed herein resides in the inclusion of an electric motor capable of operating an air-extracting element located in an odor removing duct having one end communicating with the cavity of the toilet, and its other end, after forming a trap, opening into the sewer discharge duct of the toilet, with the lower portion of the above-mentioned trap communicating, through an opening with a pumping chamber in which a hydraulic pump is enclosed, with an auxiliary tank situated thereabove for communication with the duct supplying the flushing liquid to the toilet.

In the practice, the pump enclosed in the chamber, which communicates between the lower portion of the trap and the auxiliary tank may be operated by the same electric motor which operates the extracting element or even by a second electric motor, the first alternative being preferred for obvious reasons of economy.

According to the practical embodiment of the novel extracting device, the end of the odor extracting duct can establish communication with the cavity of the toilet through an inner odor receiving portion formed in the upper edge of the toilet and provided with a number of communicating openings or it may even consist of a suction device attached to the lower face of the toilet seat. In the former, i.e., when the communication is established through the odor receiving portion formed in the upper edge of the toilet, a rear section of such duct forms an ascending portion which prevents passage of liquid from the toilet through the extracting apparatus in the event that the toilet should become flooded.

Although the novel odor extracting apparatus disclosed herein can be operated by means of a manual switch which starts the electric motor, actuation thereof is preferably automatically effected by means of a pressure switch placed between the seat and the upper edge of the toilet and operated in response to weight of the user seated on such seat. The supply circuit may also be provided with an operation-extending device of known type, which prolongs the operation of the motor for a few minutes after the weight of the user is removed from the toilet seat.

According to the tests performed, the novel extracting device makes it possible to eliminate fully the unpleasant odors of the toilet before such odors can contaminate the bathroom, which result is obtained through simple and inexpensive means, that are practically silent and do not produce appreciable currents of air in the space outside the toilet.

Other features, including both structural details and advantages of the invention, can be appreciated from the drawings attached to the present specification and claims illustrating one preferred practical embodiment of the basic inventive concept.

BRIEF DESCRIPTION OF THE DRAWINGS

Referring to the drawings the reader will appreciate that

DETAILED DESCRIPTION OF THE INVENTION

Figures 1, 2, 6:
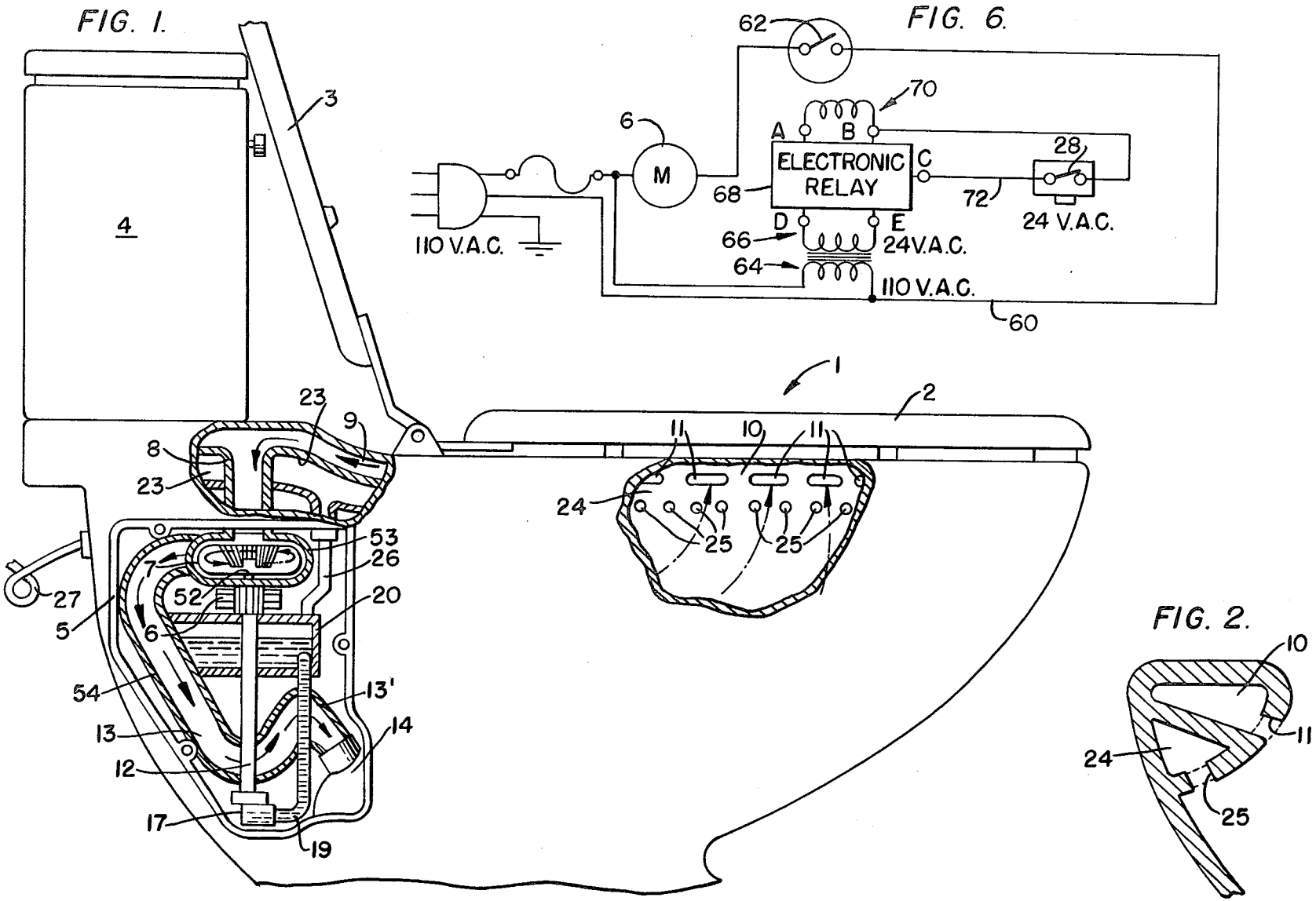
FIG. 1 shows a side view elevation of a toilet partly in section, including the novel extracting apparatus of the type wherein the suction openings are formed in an inner duct provided in the upper edge of the toilet shown with the extractor in operation.
FIG. 2 shows a partial section through the upper edge of the toilet, comprising an air-suction duct portion and a duct portion used for supplying the flushing liquid, and their respective openings of such duct portions.
FIG. 6 shows general electrical circuitry through which the disclosed odor removing apparatus may be put into operation.
Figures 3, 7:
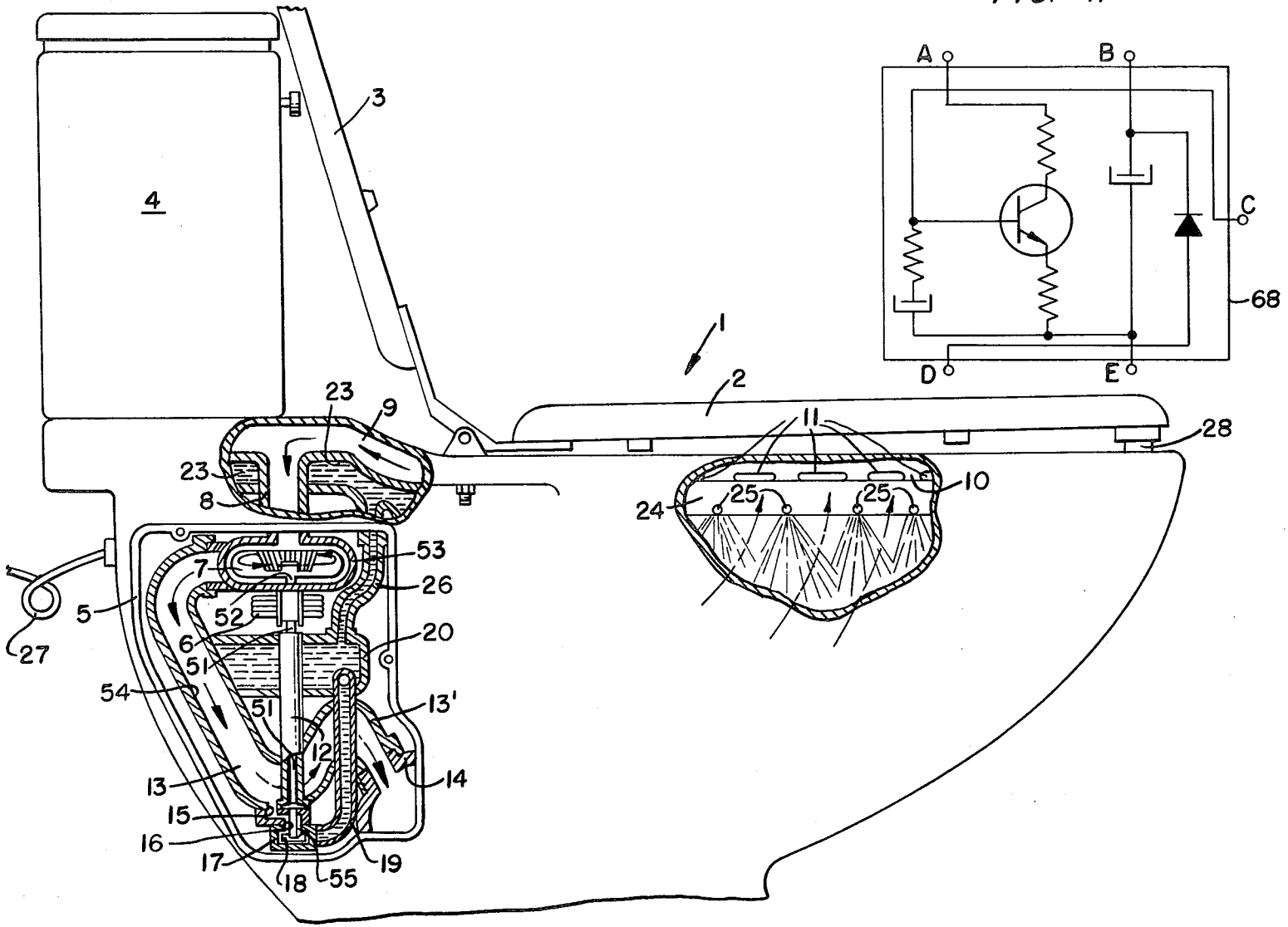
FIG. 3 shows the toilet of FIG. 1 wherein the discharge of flushing water is triggered while the extracting apparatus continues its operation on account of a known operation-extending device.
FIG. 7 shows internal circuitry of an electronic component of the circuitry of FIG. 6.

Referring now in detail to the drawings the reader will appreciate that the present invention embodies in FIGS. 1 and 3 a toilet 1, having a seat 2, a cover 3 and a water tank 4, which elements are of known type.

The rear portion of the toilet 1 comprises an enclosure 5, the interior of which contains the odor removing or extracting apparatus R which includes an electric motor 6 having a vertical shaft 51 with an upper half-shaft 52 operating an extracting element 7 secured thereto, which is of the centrifugal type in the case shown. An odor removing duct 8 communicates through a duct 9 with an inner odor receiving portion 10 formed around the inner periphery of the toilet adjacent the upper edge thereof. The odor receiving portion 10 may be seen to comprise a plurality of suction openings 11 arranged around the cavity of the toilet 1. Extracting element 7 is disposed in a suction chamber 53 and discharges the air extracted from the upper intake section of duct 8 into an intermediate section 54 which extends to a trap portion 13 at its lower portion and then to a downwardly extending discharge section which empties into a sewer discharge duct 14 of the toilet.

Trap portion 13 which is U-shaped includes an opening 15 at the bottom thereof adjacent its upstream end through which it communicates with a central opening 16 of a pump chamber 17. At the downstream end of trap 13 is a downwardly directed discharge section 13'. An hydraulic pump 18 of the centrifugal type is seen to be disposed in pumping chamber 17. A passage 19 connects pumping chamber 17 with an auxiliary tank 20 located above pumping chamber 17. Pump 18 is secured to a lower half-shaft 55 of vertical shaft 51 so that when motor 6 is operating to effect odor removal by driving extracting element 7, it will simultaneously be driven to clear trap portion 13 by evacuating the water forming the trap from trap portion 13 through opening 15, central opening 16, pumping chamber 17, passage 19 to auxiliary tank 20 to thereby allow for movement of undesirable odor from the toilet 1 by suction action of extracting element 7 through trap portion 13 and into sewer discharge duct 14. Passage 19 terminates at its upper end in the vicinity of the bottom of auxiliary tank 20.

Fresh flush water is supplied from tank 4 through a descending supply duct 23 when the flush valve (not shown) is opened. Supply duct 23 extends to an inner duct portion 24 formed in the upper edge of the toilet 1, below odor receiving portion 10. Inner duct 24 is provided with openings 25 discharging into the cavity of the toilet 1 whereby flushing may be effected when desired. Supply duct 23 may thus communicate with toilet 1.

Auxiliary 20 includes a second passage 26 which extends upwardly therefrom into communication with supply duct 23 to obtain make-up water therefrom.

Electric current is supplied through conductor 27 to operate electric motor 6, which has a feed circuit including a pressure switch 28 and, possibly, also a known, operation-extending component which is not shown.

Figure 5:
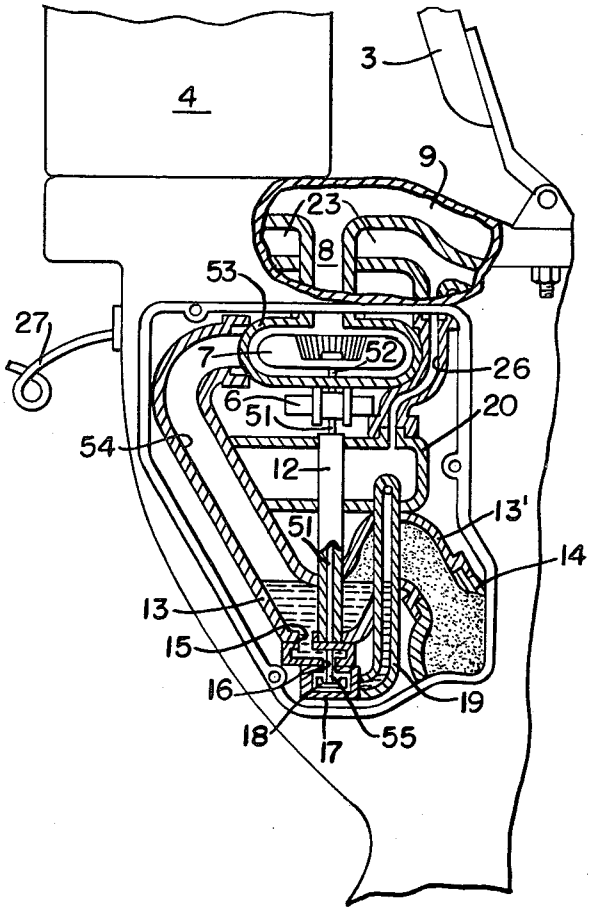
FIG. 5 is a view similar to FIG. 4 with the disclosed apparatus in an idle condition.

Operation of the disclosed invention may be understood by considering firstly the idle or inoperative condition thereof as illustrated in FIG. 5 and secondly FIG. 1 when the weight of a user sitting down on seat 2 is present to depress pressure switch 28 to start electric motor 6 so that lower half-shaft 55 of motor 6 will operate pump 18 to force the water trap from trap 13 through passage 19 into auxiliary tank 20 and upper half-shaft 52 of motor 6 will simultaneously operate extracting element 7, which will draw the air from the interior of the toilet 1 through suction openings 11, odor receiving portion 10, and ducts 9 and 8, forcing such odor then through an intermediate portion 12, and trap portion 13 to sewer-discharge duct 14. It should be noted that the volume of trap portion 13 is less than that of auxiliary tank 20, so that the latter will be only partially filled as can be seen in FIG. 1.

When the user rises from the seat 2, an operation-extending device provided in the disclosed arrangement will continue operation of electric motor 6 for a few additional minutes in spite of the fact that the pressure was removed from switch 28 as illustrated in FIG. 3. If in such conditions the valve of tank 4 is operated, the flushing water will pass through the descending portion of supply duct 23 to inner duct 24 and openings 25, thus flushing the toilet in known manner. However, a portion of the liquid will pass through passage 26 to auxiliary tank 20 and fill it up.

Figure 4:
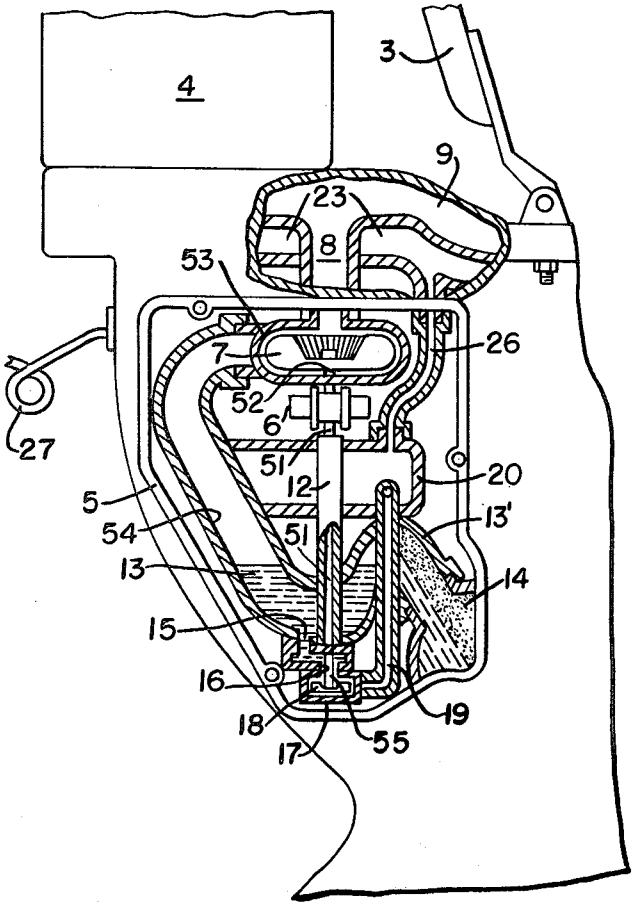
FIG. 4 shows a partial side elevational view of the extracting device at the instant when the operation of the extracting device is ended subsequent to the completion of the toilet-flushing phase.

When the flushing operation of the toilet 1 is completed and the action of the operation-extending device ceases, electric motor 6 will stop. Consequently, the suction of air performed by extractor 7 will cease and at the same time, on stopping of pump 18, the water from tank 20 will pass by gravity through passage 19 and openings 16 and 15 to trap portion 13. The excess of water, which filled auxiliary tank 20 in the manner explained above, will overflow the edge of trap portion 13 to sewer discharge duct 14 as may be seen in FIG. 4, thus ensuring a complete filling of trap portion 13 as well as a partial renewal of the latter, so that the apparatus will finally return to its inoperative position shown in FIG. 5.

Emphasis is placed on the fact that the described extracting apparatus extracts the malodorous air from the toilet 1 and discharges it into the actual sewer-discharge duct 14 of the toilet 1. Therefore, it is not necessary to provide any other arrangement for discharging and neutralizing the extracted air. On the other hand, the existence of a trap portion comprising a renewable water seal placed in the sewer-discharge duct 14 prevents the passage of gases from the sewer to the toilet 1.

The novel extractor could operate in the same manner when odor receiving portion 10 and suction openings 11 are replaced by a suction outlet placed below seat 2 and suitably connected to extracting element 7.

Discharge section 13' is directed downwardly from trap portion 13 at the downstream end thereof so that any water gravitating from auxiliary tank 20 into trap portion 13 in excess of the capacity of the latter will inherently spill into sewer discharge duct 14.

To enable operation of motor 6 for driving pump 18 and extractor element 7, which is in the form of a suction fan, motor 6 is in a 110 volt alternating current circuit 60 such as illustrated in FIG. 6. The circuit 60 includes a switch 62 which may be of the reed type and is normally open when the system is not in use. Circuit 60 includes a coil 64 which by-passes motor 6. Arranged in operative relationship with coil 64 is a coil 66 connected to one side of an eletronic relay 68 having a coil 70 along another side thereof in close proximity to switch 62. Electronic relay 68, as may be more clearly seen in FIG. 7 is provided with junctions A,B for coil 70, junctions D,E for coil 66, and a junction C is included in a 24 volt alternating current circuit 72 which includes pressure switch located under seat 2 when the latter is lowered to its use position. Coil 70 is connected up to 24 volt circuit 72 at junction B. Until there is pressure on switch 28 from the weight of a person seated on seat 2, switch 28 is open and switch 62 is open so that motor 6 is not driven. As soon as the weight of a person is placed on seat 2, switch 28 closes, current is delivered through 24 volt circuit 72 to energize coil 70 which in turn effects a magnetic field to close switch 62 to deliver current to motor 6 by way of circuit 60 and thus effect removal of odor by clearing trap portion 13 of the water trapped therein and sucking odor through openings 11 in the direction of arrows toward receiving portion 10, through ducts 9,8, suction chamber 53, intermediate section 54, trap portion 13, discharge section 13', and sewer discharge duct 14. Operation of motor 6, as described above, enables pump 18 to clear trap portion 13 of water by pumping same up to auxiliary tank 20 via openings 15 and 17, suction chamber 17, and passage 19 and fan 7 to draw the odors from toilet 1.

When the person using toilet 1 rises from seat 2 operation of motor 6 may continue for several minutes thereafter.

Shaft 51 is enclosed in a protective tube 12 passing through trap portion 13 and auxiliary tank 20 and sealed against leakage therefrom.

It will be obvious to those skilled in the art that various changes may be made without departing from the scope of the invention and therefore the invention is not limited to what is shown in the drawings and described in the specification but only as indicated in the appended claims.

What is claimed is:

1. A toilet comprising a bowl with a conventional cavity; a flush water supply tank; and auxiliary tank; a pumping chamber; an odor removing duct including an odor receiving portion extending around the inner periphery of the bowl adjacent its upper edge and a rearward portion leading from said odor receiving portion to an upwardly extending section, and a downwardly extending section with a suction chamber, and trap portion at the lower level of said duct in combination with an odor extracting apparatus including an extractor element located in said suction chamber, an hydraulic pump located in said pumping chamber, and a drive motor having a shaft with one end drivingly connected to said extractor element and its other end drivingly connected to said hydraulic pump for simultaneously driving said extractor element and said hydraulic pump; said auxiliary tank being situated at a level below said flush water supply tank and at a level above said pumping chamber and including a first passage connecting said supply tank to said auxiliary tank and a second passage connecting said pumping chamber to said auxiliary tank; said pumping chamber having an opening communicating with said trap portion through a perforation in the bottom of said trap portion adjacent the upstream end thereof whereby water from said auxiliary tank will provide a water trap in said trap portion to prevent sewer gas from backing in said toilet during idle condition thereof; said pump operating to evacuate water forming a trap in said siphon portion to said auxiliary tank simultaneous with operation of said extractor element to remove odor from said toilet.

2. The combination as defined in claim 1 wherein said trap portion includes a downstream end discharging into a sewer duct.

3. The combination as defined in claim 1 wherein said auxiliary tank has a greater water holding capacity than said trap portion has.

4. The combination as defined in claim 1 wherein said odor receiving portion includes a plurality of openings through which odor may pass from said bowl cavity into said odor removing duct.

5. The combination as defined in claim 4 wherein said bowl includes a flush water supply duct extending around the inner periphery of said bowl just beneath said odor receiving portion, said flush water supply duct including a plurality of openings through which water may be discharged into said bowl to effect flushing thereof.

6. The combination as defined in claim 1 wherein said bowl includes a flush water supply duct extending around the inner periphery of said bowl and including a plurality of openings through which water may be discharged into said bowl to effect flushing thereof.

7. The combination as defined in any of claims 1–7 including a pressure responsive switch on the upper edge of said bowl for actuating said drive motor.

* * * * *